US007270313B1

(12) United States Patent
Counts

(10) Patent No.: US 7,270,313 B1
(45) Date of Patent: Sep. 18, 2007

(54) CARBURETOR FUEL METERING APPARATUS HAVING AN ELONGATE SPRAY NOZZLE AND V-SHAPED DEFLECTOR

(76) Inventor: Paul Counts, Haysville Health Care Center, 215 N. Lamar, Haysville, KS (US) 67060

( * ) Notice: Subject to any disclaimer, the term of this patent is extended or adjusted under 35 U.S.C. 154(b) by 0 days.

(21) Appl. No.: 11/435,536

(22) Filed: May 17, 2006

(51) Int. Cl.
*F02M 7/14* (2006.01)

(52) U.S. Cl. ..... 261/62; 251/120; 251/279; 261/71; 261/118; 261/DIG. 39

(58) Field of Classification Search ..... 261/62, 261/71, 78.1, 78.2, 115, 118, DIG. 39; 251/120, 251/279
See application file for complete search history.

(56) References Cited

U.S. PATENT DOCUMENTS

| | | | | | |
|---|---|---|---|---|---|
| 1,788,914 | A | * | 1/1931 | Hamlin | 261/46 |
| 3,207,492 | A | * | 9/1965 | Zikesch | 261/46 |
| 3,680,846 | A | * | 8/1972 | Bickhaus et al. | 261/51 |
| 3,747,906 | A | * | 7/1973 | Arnold et al. | 261/118 |
| 3,767,174 | A | * | 10/1973 | Heeney | 261/62 |
| 4,054,621 | A | * | 10/1977 | Bubniak et al. | 261/46 |
| 4,266,571 | A | | 5/1981 | Bauder | |
| 4,272,460 | A | * | 6/1981 | Watanabe et al. | 261/53 |
| 4,351,305 | A | * | 9/1982 | Isogai et al. | 123/590 |
| 4,559,185 | A | * | 12/1985 | Seto et al. | 261/41.5 |
| 4,751,942 | A | | 6/1988 | Dyer et al. | |
| 4,783,286 | A | * | 11/1988 | Lee | 261/23.2 |
| 5,562,869 | A | * | 10/1996 | Drahos et al. | 261/71 |
| 5,694,904 | A | | 12/1997 | Osanai | |
| 6,755,622 | B1 | | 6/2004 | Hartnagel et al. | |
| 6,782,692 | B2 | | 8/2004 | Hodinot et al. | |
| 6,802,300 | B2 | | 10/2004 | Dutt | |
| 2002/0060374 | A1 | * | 5/2002 | Berriman et al. | 261/78.1 |

FOREIGN PATENT DOCUMENTS

JP 6-147015 A * 5/1994

* cited by examiner

*Primary Examiner*—Richard L. Chiesa
(74) *Attorney, Agent, or Firm*—Gene Scott; Patent Law & Venture Group

(57) ABSTRACT

A fuel metering apparatus provides a carburetor; a fuel float control, a fuel metering assembly and a rocker arm assembly. The rocker arm is mechanically linked to and is operated by an accelerator pedal. Its position determines the size of a gap between a fuel metering tube and the metering piston, of the fuel metering assembly, to adjust a gap between the metering piston and a metering tube, which determines the precise rate of fuel flowing into the carburetor's air stream.

7 Claims, 3 Drawing Sheets

CARBURETOR FUEL METERING APPARATUS HAVING AN ELONGATE SPRAY NOZZLE AND V-SHAPED DEFLECTOR

CROSS-REFERENCE TO RELATED APPLICATIONS

Not Applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to fuel metering devices and more particularly to a fuel metering device having an elongate spray nozzle and V-shaped deflector.

2. Description of Related Art Including Information Disclosed Under 37 CFR 1.97 and 1.98

Dutt, U.S. Pat. No. 6,802,300 discloses a lift-controlled valve as a fuel metering device of an injection system for internal combustion engines which has a valve needle which may be actuated axially against the resistance of a spring, the valve needle being situated in a graduated coaxial recess in a valve body and interacting with a valve seat formed in the recess of the valve body in this case controlling the fuel injection process; the valve has in addition a high-pressure area which is connected to an assigned injection nozzle and which is located upstream from the valve seat, a low-pressure area which is located downstream from the valve seat and which opens out into a fuel return flow, and a low-pressure equalizing piston which coaxially adjoins the valve and which is fixedly connected to the valve needle. The characterizing feature is that a first control edge is formed on the low-pressure equalizing piston, the control edge interacting with a second control edge on the valve body recess in the area of the fuel return flow or in such a way that a throttle cross-section which is dependent on the valve lift is formed between the two control edges. Hodinot, et al., U.S. Pat. No. 6,782,692 discloses in a turbomachine, there is provided a fuel metering unit having a cylindrical outer sleeve containing a distributor cylinder in which a metering piston can be moved linearly under the action of a control element. The cylindrical sleeve has an inlet orifice for admitting fuel under pressure and at least one outlet orifice for injecting fuel into a combustion chamber of the turbomachine, and the metering piston has an annular gap forming a distribution chamber for the fuel admitted via the inlet orifice and delivered via at least one outlet orifice. According to the invention, the distributor cylinder has a plurality of radial feed orifices for admitting fuel into the distribution chamber and at least a first metering orifice and at least a second metering orifice that are separated by a seal disposed at the periphery of the distributor cylinder. Hartnagel et al., U.S. Pat. No. 6,755,622 discloses a fuel metering pump which has a solenoid coil, an armature, a delivery piston and spring-loaded valves. The spring-loaded valves are embodied as an electrically controlled suction valve and an electrically controlled pressure valve. A solenoid coil is provided for the armature of the delivery piston, the armature of the suction valve and the armature of the pressure valve. The masses, springs and hydraulic cross-sections of the component parts are configured in such a way that the valves switch more quickly than the delivery piston moves. Nuti, U.S. Pat. No. 5,694,905 discloses a fuel metering arrangement in devices for pneumatically assisted direct fuel injection into an internal combustion engine cylinder head provided with a chamber housing a connecting rod for operating a compression piston slidingly guided within a jacket provided with one or more transfer conduits connecting said internal chamber to a variable-dimension space positioned downstream of the piston and upstream of a valve providing access to a combustion chamber, fuel feed means being connected to said variable-dimension space. In this manner a very rapid transient is achieved during acceleration. Dyer, et al., U.S. Pat. No. 4,751,942 discloses a hybrid fuel metering system incorporating a multi-function control valve is shown. The valve has a sleeve, a piston mounted for translational movement within the sleeve and a spool mounted for translational movement in the piston. The piston has three positions for cooperating with the sleeve; a variable first position for metering fuel to an engine, a second position for directing fuel to a metering valve and a third position for shutting off flow to the metering valve and to the engine to correct engine overspeed. The spool has two positions, a first position to shut off flow to the engine and to the metering valve to shut off the engine and a variable second position to position the piston to meter flow to the engine. Bander, U.S. Pat. No. 4,266,571 discloses a fuel metering valve for fuel injection to an internal combustion engine, comprising a rotary valve piston movable in a valve cylinder and having a spiral groove cooperating with a number of spaced valve ports in the cylinder, each port of triangular cross-section. Fuel is admitted to one end of the spiral groove and delivered through the ports in the cylinder. Rotation of the piston progressively opens the ports simultaneously.

The related art described above discloses several fuel metering systems with control pistons. However, the prior art fails to disclose the novel structural arrangement of the present invention as described in this specification. The present disclosure distinguishes over the prior art providing heretofore unknown advantages.

BRIEF SUMMARY OF THE INVENTION

This disclosure teaches certain benefits in construction and use which give rise to the objectives described below.

A fuel metering apparatus provides a carburetor 13, a fuel metering assembly and a rocker arm assembly. The rocker arm is mechanically linked to and is operated by an accelerator pedal. Its position determines the size of a gap between a fuel metering tube and the metering piston, of the fuel metering assembly. The gap between the metering piston and a metering tube determines the precise rate of fuel flowing into the carburetor's air stream.

A primary objective inherent in the above described apparatus and method of use is to provide advantages not taught by the prior art.

Another objective is to provide a simplified engine fuel metering system.

A further objective is to provide a variable fuel admittance arrangement with highly refined control.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
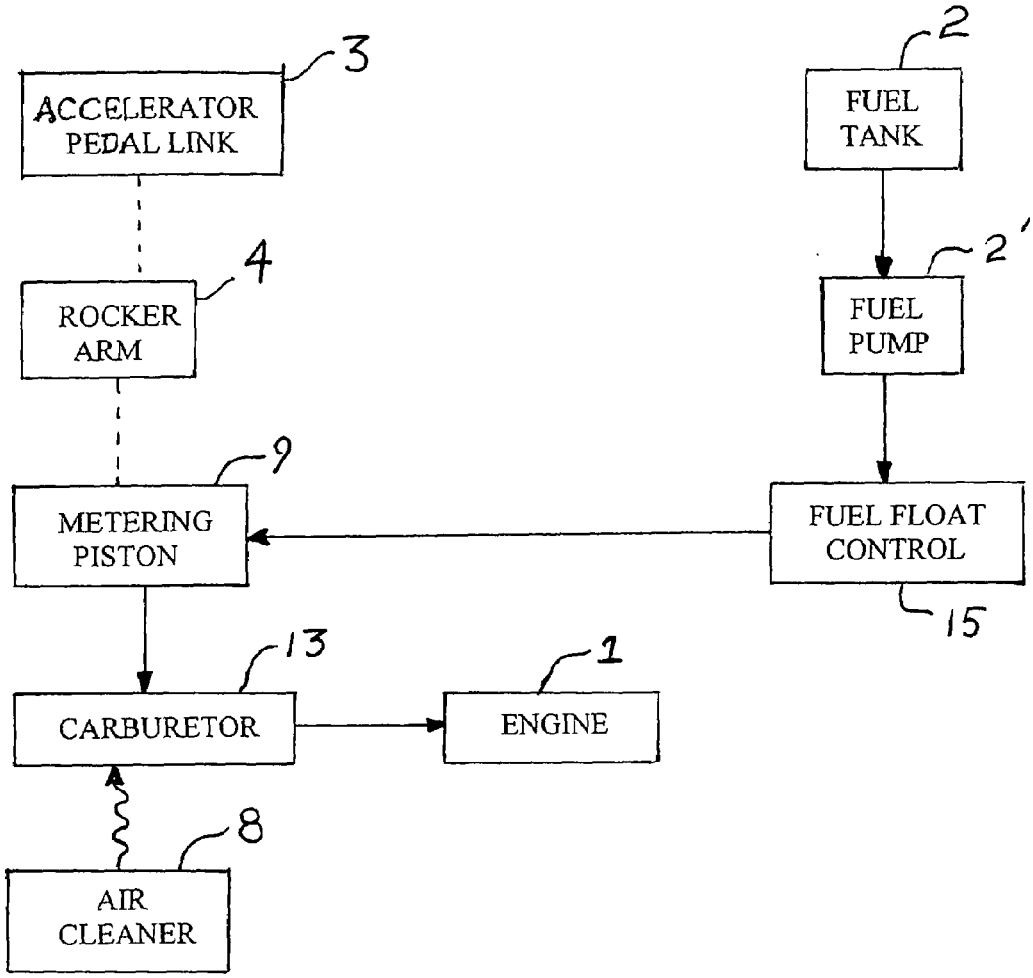
FIG. 1 is a block diagram showing the relationships between the several components of the present invention and other associated components.

Described now in detail is a carburetor fuel metering apparatus for an internal cumbustion engine 1. As shown in FIG. 1, an accelerator pedal link 3 is mechanically engaged with a rocker arm assembly 4, which is in-turn mechanically engaged with a metering piston 9 within a carburetor 13. The carburetor 13 feeds gas-air mixture to the internal combustion engine 1. Fuel from a fuel tank 2 is driven by a fuel pump 2' to the metering tube 10 which dispenses fuel as an aerosol within the carburetor 13.

Figure 2:
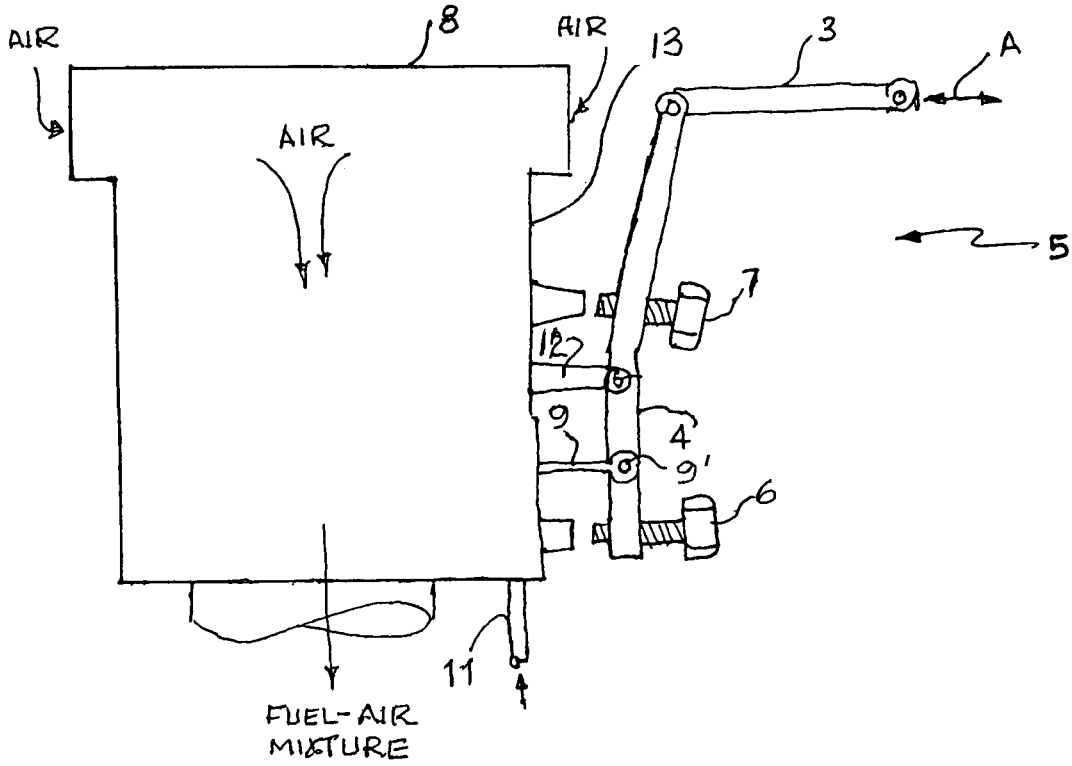
FIG. 2 is a mechanical schematic diagram showing a rocker arm assembly engaged with a carburetor.

The fuel metering apparatus includes a fuel metering assembly including the fuel metering tube 10 and the fuel metering piston 9, and a rocker arm assembly 5. The assembly 5 uses a rocker arm 4 pivotally mounted on the carburetor 13 by pivot arm 12 as shown in FIG. 2. The rocker arm 4 is adapted for receiving mechanical forces from an accelerator pedal (not shown) which is mechanically linked through link 3 which is therefore able to move in accordance with arrow "A," to control rocker arm 4. Arm 4 is provided with a means for setting idle speed 6, and for setting maximum fuel flow 7, preferably the set screws shown in FIG. 2.

Between idle and maximum positions of the rocker arm 4, as set by means 6 and 7, lies a range of normal fuel flow during operation of engine 1 over a desired RPM range. Rocker arm 4 is pivotally engaged with the fuel metering piston 9 as shown in FIG. 2, and therefore piston 9 is able to move toward and away from the fixed fuel metering tube 10 depending on the amount of fuel that is to be released into the air stream of the carburetor 13 per unit time. The position of piston 9 relative to tube 10 sets a gap 14 shown in FIG. 3A, and this gap 14 determines the rate by which fuel is sprayed into the carburetor 13. The arrangement of link 3 and rocker arm 4 and the position of the joint 9' between metering piston 9 and rocker arm 4, sets the total travel of piston 9 to be only 1/32 of an inch so that the full range of fuel volume flow is adjusted within the 1/32 inch gap travel.

Now describing the critical elements of the instant invention in more detail, we have a fuel metering apparatus for use in a carburetor 13, the metering apparatus having a rectangular fuel metering tube 10 providing a fuel conduction path 5 therethrough from a fuel receiving port 11 at one end thereof, to an elongate fuel dispensing port 11' at the other end thereof. The fuel dispensing port 11' is centered on a convergent tip 10' of the metering tube 10. Please refer to FIG. 3A.

Figure 3A:
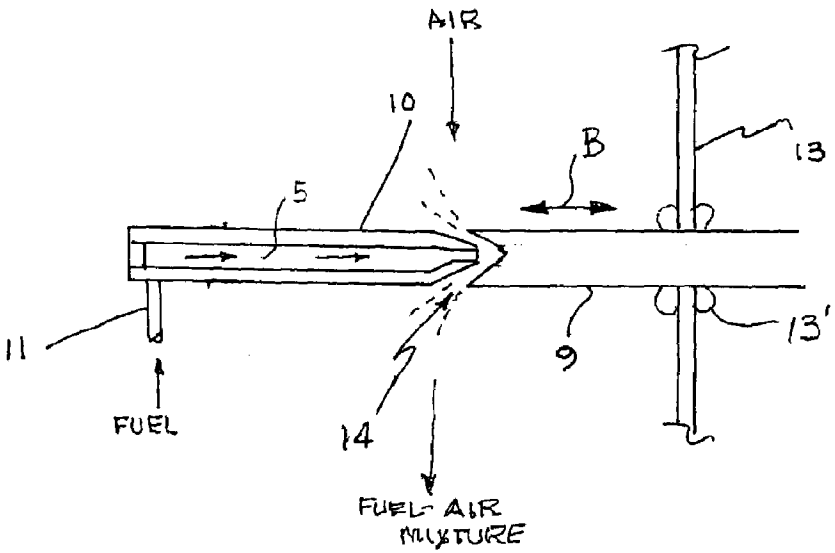
FIG. 3A is a schematic diagram showing a relationship between a fuel metering piston controlled by the rocker arm, and a fuel supply tube having an elongate nozzle.
Figure 3C:
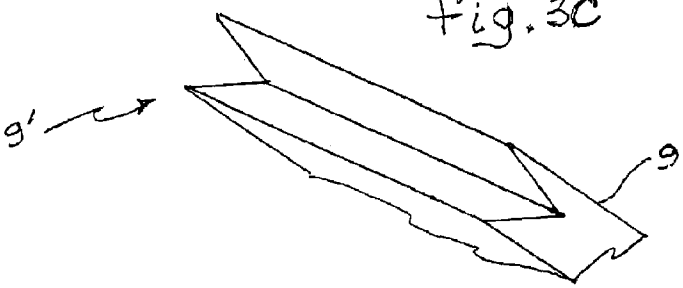
FIG. 3C is a perspective view of the distal end of the metering piston showing its V-shaped deflecting surface.

A rectangular fuel metering piston 9 is positioned in line with the metering tube 10 as shown in FIG. 3A, the metering piston 9 providing a V-shaped terminal end 9' as shown in FIG. 3C, the terminal end 9' positioned adjacent to the convergent tip 10' of the metering tube 10 as shown in FIG. 3A. The metering piston 9 is made of hard nitrile rubber which has been shown to provide superior performance to a non-resiliant material. In this regard, only the distal end of piston 9 need be made of such resiliant material. Alternatively, the V-shaped terminal surfaces may be coated with nitrile rubber.

A rocker arm assembly 5 is engaged with the metering piston 9 for moving it in linear sliding motion, see arrow B, in a journal 13' mounted in a wall of the carburetor 13, so as to adjust a gap 14 between the metering tube's convergent tip 10' and the metering piston's V-shaped terminal end 9'.

The metering tube 10 and the metering piston 9 are adapted, as would be a routine matter for one of skill in the art, for being secured within the carburetor 13 for spraying fuel flowing within the metering tube 10 into air flowing within the carburetor 13.

Figure 3B:
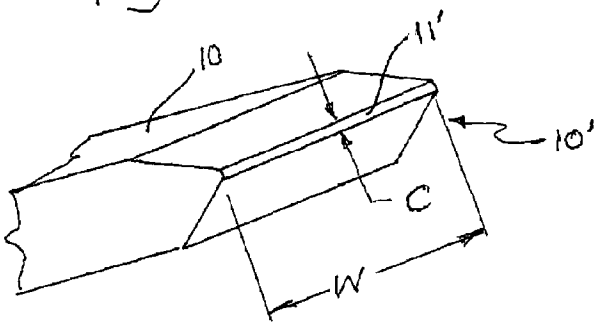
FIG. 3B is a perspective view of the tip of the elongate nozzle.

The rocker arm assembly 5 provides a maximum fuel setting stop 6, and an idle fuel setting stop 7 as shown in FIG. 2. In the travel between idle and maximum fuel flow, the convergent tip 10' is positioned within the V-shaped terminal end 9' of metering piston 9. It has been found that fuel moving through the elongate dispensing port 11', which is preferably between about 0.002 and 0.008 inches across, (see dimension C in FIG. 3B), and under pressure from the fuel pump 2', or from the gravity fed fuel float control 15, moves against the V-shaped terminal end 9' and is therefrom dispersed as an aerosol into the air stream moving through the carburetor 13.

The width W of port 11' is selected for the size engine in use, with W being linearly proportional to engine displacement. See FIG. 3B.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A fuel metering apparatus for a carburetor, the metering apparatus comprising:

a) a rectangular fuel metering tube providing a fuel conduction path therethrough from a fuel receiving port at one end thereof, to an elongate fuel dispensing port at the other end thereof, the fuel dispensing port centered on a convergent tip of the metering tube;

b) a rectangular fuel metering piston positioned in line with the metering tube, the metering piston providing a V-shaped terminal end, the terminal end positioned adjacent to the convergent tip of the metering tube;

c) a rocker arm assembly engaged with the metering piston for moving the metering piston in linear sliding motion in a journal so as to adjust a gap between the metering tube and the metering piston;

the metering tube and the metering piston adapted for being secured within the carburetor for spraying fuel flowing within the metering tube into air flowing within the carburetor.

2. The apparatus of claim 1 wherein the rocker arm assembly provides a maximum fuel setting stop.

3. The apparatus of claim 1 wherein the rocker arm assembly provides an idle fuel setting stop.

4. A fuel-air mixing apparatus comprising:

a) a carburetor;

b) a rectangular fuel metering tube within the carburetor, the metering tube providing a fuel conduction path therethrough from a fuel receiving port at one end thereof, to an elongate fuel dispensing port at the other end thereof, the fuel dispensing port centered on a convergent tip of the metering tube;

c) a rectangular fuel metering piston slidingly engaged with a journal and positioned in line with the metering tube, the metering piston providing a V-shaped terminal end, the terminal end positioned adjacent to the convergent tip of the metering tube;

d) a rocker arm assembly engaged with the metering piston for moving the metering piston in linear sliding motion in the journal so as to adjust a gap between the metering tube and the metering piston;

the metering tube and the metering piston secured within the carburetor for spraying fuel flowing within the metering tube into air flowing within the carburetor.

5. The apparatus of claim 4 wherein the rocker arm assembly provides a maximum fuel setting stop.

6. The apparatus of claim 4 wherein the rocker arm assembly provides an idle fuel setting stop.

7. The apparatus of claim 4 wherein at least one surface of the metering piston is of nitrile rubber.

* * * * *